US006196195B1

(12) United States Patent
Trutschel et al.

(10) Patent No.: US 6,196,195 B1
(45) Date of Patent: Mar. 6, 2001

(54) THERMAL INSULATING SLEEVE

(75) Inventors: Ralf Trutschel, Kornwestheim; Guido Pilgram, Schwieberdingen; Rainer Norgauer, Ludwigsburg; Christian Preussner, Markgröningen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/308,917

(22) PCT Filed: Jul. 8, 1998

(86) PCT No.: PCT/DE98/01888

§ 371 Date: May 26, 1999

§ 102(e) Date: May 26, 1999

(87) PCT Pub. No.: WO99/17015

PCT Pub. Date: Apr. 8, 1999

(30) Foreign Application Priority Data

Sep. 30, 1997 (DE) ..... 197 43 103

(51) Int. Cl.[7] ..... F02M 55/02
(52) U.S. Cl. ..... 123/470; 123/41.31
(58) Field of Search ..... 123/470, 41.31, 123/541, 509, 446, 472

(56) References Cited

U.S. PATENT DOCUMENTS 2,080,189 * 5/1937 Schwaiger ..... 123/41.31
2,777,431 * 1/1957 Meurer ..... 123/470
3,334,617 * 8/1967 Palkowsky ..... 123/41.31
3,945,353 * 3/1976 Dreisen ..... 123/41.31
4,201,172 * 5/1980 Jaggle ..... 123/470
4,625,682 * 12/1986 Dietrich ..... 123/41.31

FOREIGN PATENT DOCUMENTS 24 51 548 5/1976 (DE) .
30 00 061 6/1981 (DE) .
195 46 134 1/1997 (DE) .
0294586 * 12/1988 (EP) ..... 123/470
759 524 10/1956 (GB) .
404086368 * 3/1992 (JP) ..... 123/470

* cited by examiner

*Primary Examiner*—Carl S. Miller
(74) *Attorney, Agent, or Firm*—Kenyon & Kenyon

(57) ABSTRACT

A thermal insulating sleeve for a fuel injection valve, which can be inserted in a mounting hole of a cylinder head of an internal combustion engine, has a sleeve body which at least partially envelops a nozzle body of the fuel injection valve. At the injection end of the sleeve body there is a folded-back section, in which the sleeve body has a two-layered configuration, and there is a conical section, which tapers in the direction toward the injection end and which in the assembled state fits tightly against the tapered section of the nozzle body.

10 Claims, 2 Drawing Sheets

THERMAL INSULATING SLEEVE

FIELD OF THE INVENTION

The present invention relates to a thermal insulating sleeve for a fuel injection valve, which can be inserted in a mounting hole of a cylinder head of an internal combustion engine, for the direct injection of fuel into the combustion chamber of the internal combustion engine, in particular for a gasoline direct injection valve or diesel direct injection valve.

BACKGROUND INFORMATION

The provision of a thermal insulating sleeve at the nozzle body of a fuel injection valve is already known from German Patent No. 30 00 061 C2. A flange of the thermal insulating sleeve is inserted in an interior groove of the fuel injection valve and is sealed against the mounting hole of the cylinder head by a sealing ring. At the injection end, the thermal insulating sleeve has a ring-shaped collar bent toward the interior on which an elastic thermal insulating ring is supported. The thermal insulating ring is arranged between the injection end of the nozzle body of the fuel injection valve and the ring-shaped inwardly bent collar of the thermal insulating sleeve.

In a fuel injection nozzle known from British Patent No. 759 524, a pliable thermal insulating element, inserted as a disk-shaped thermal insulating ring between a face of the nozzle body and a collar of a tension nut, is formed from a thermal insulating material. To protect the inner side of the thermal insulating ring not covered by the collar or by the nozzle body from the corrosion by the combustion gases, this inner side is edged with a ring with a U-shaped cross section formed from a thin metal sheet.

A drawback of the thermal insulating sleeve according to the definition of the species is that it requires a relatively great assembly expenditure since the thermal insulating sleeve must be pre-assembled on the fuel injection valve. In addition, an additional sealing ring is necessary to seal the mounting hole of the cylinder head from combustion gases, resulting in an increase in the manufacturing and assembly effort and not least in costs. Dissipation of the heat, which develops in the nozzle body as a result of the combustion of the internal combustion engine, across the thermal insulating sleeve to the cylinder head is possible in the known configuration of the thermal insulating sleeve only to a limited extent.

SUMMARY OF THE INVENTION

In contrast, the thermal insulating sleeve according to the present invention has the advantage that assembly is made significantly easier. As a result of a folded-back section, the thermal insulating sleeve according to the present invention is configured to be radially elastic in this area. The thermal insulating sleeve therefore fits elastically in the area of the folded-back section both on the nozzle body of the fuel injection valve and on the mounting hole of the cylinder head. Through a conical section of the thermal insulating sleeve which fits tightly on a tapered section of the nozzle body, an axial transfer of force from the nozzle body of the fuel injection valve to the heat insulating sleeve is made possible. As a result of the conical configuration, self-centering is ensured. In addition, the conical configuration causes a degree of flaring of the radially elastic, folded-back section during assembly so that the axial assembly force is reduced.

The folded-back section, because of its close fit both on the nozzle body and on the mounting hole, ensures a sufficient seal for the fuel injection valve of the mounting hole of the cylinder head with respect to the combustion gases which are created in the combustion chamber of the internal combustion engine. An additional sealing ring is not necessary for the seal. As result of the elastic fit of the folded-back section both on the nozzle body of the fuel injection valve and on the mounting hole of the cylinder head, a good thermal coupling between the nozzle body of the fuel injection valve and the cylinder head is achieved through which overheating of the nozzle body is counteracted.

If a gap is formed between an inner layer and an outer layer of the folded-back section, a particularly high radial elasticity of the folded-back section results. The folded-back section can be bent in a U-shape in cross section. If the folded-back section follows directly after the conical section of the sleeve body, a particularly effective flaring of the folded-back section arises upon assembly of the fuel injection valve. If the sleeve body has a hollow cylindrical section, the internal diameter of which is larger than the external diameter of the section of the nozzle body which in the assembled state is inserted into the hollow cylindrical section, sufficient play between the nozzle body of the fuel injection valve and the mounting hole in the cylinder head will be present in this area.

A collar formed at the end opposite the injection end provides a stop for the thermal insulating sleeve at a step of the mounting hole of the cylinder head which is formed as a stepped hole, thereby fixing the final assembly position of the fuel injection valve in the thermal insulating sleeve. The sleeve body and the collar can advantageously be configured as a one-piece, deep-drawn sheet metal part, which can be manufactured particularly inexpensively. The folded-back section can likewise be inexpensively manufactured through flanging or bending.

DETAILED DESCRIPTION

Figure 1:
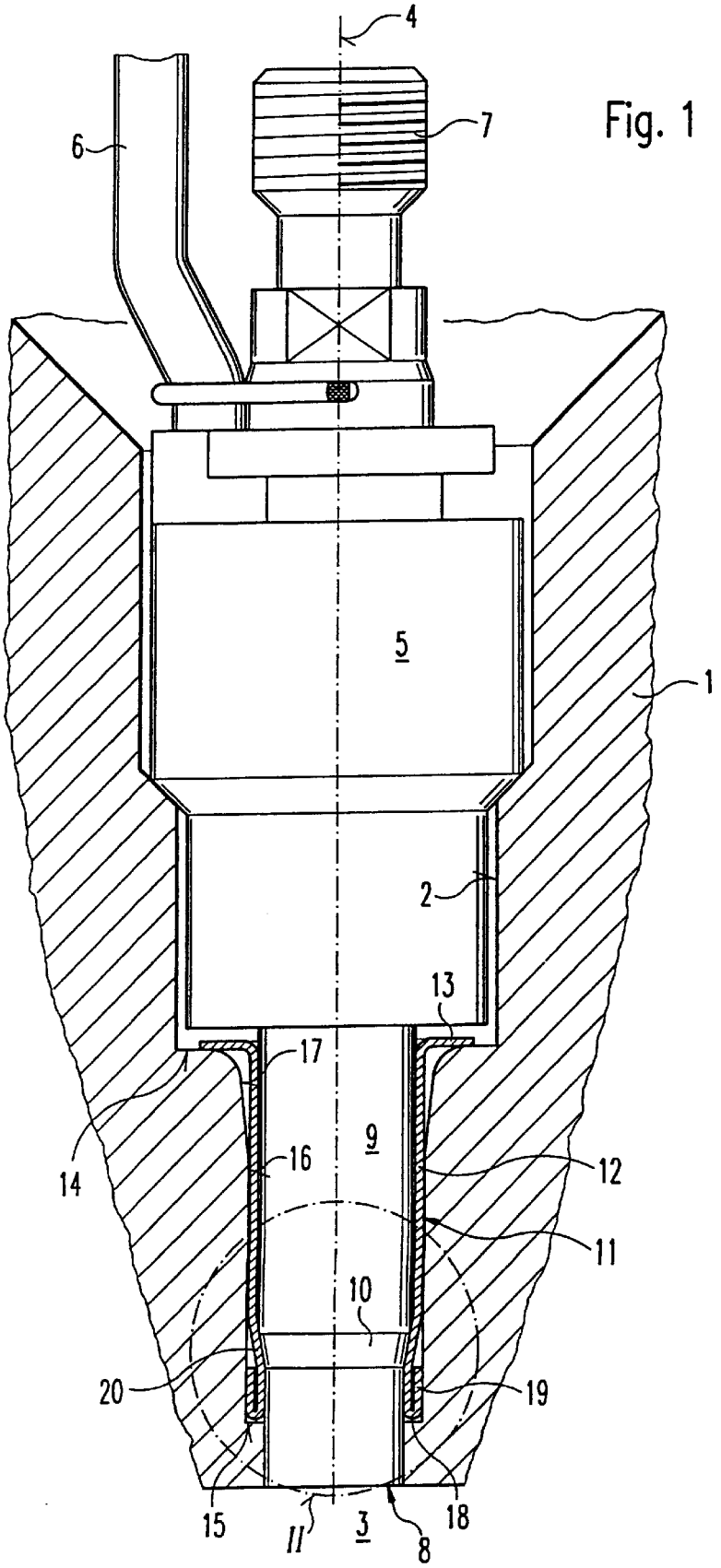
FIG. 1 shows a fuel injection valve with a thermal insulating sleeve according to the present invention inserted into a mounting hole of a cylinder head, with the thermal insulating sleeve and the cylinder head which is only partially depicted presented in section view.

In FIG. 1, a partial section of a cylinder head 1 of an internal combustion engine is depicted. In cylinder head 1, a mounting hole 2 formed as a stepped hole is formed which extends symmetrically to a longitudinal axis 4 to a combustion chamber 3. In mounting hole 2 of cylinder head 1, a fuel injection valve 5 is inserted. Fuel injection valve 5 serves to directly inject fuel, for example gasoline or diesel fuel, into combustion chamber 3 of the internal combustion engine. Fuel injection valve 5 advantageously can be activated electromagnetically via an electric connection cable 6. The fuel enters fuel injection valve 5 through a fuel admission connector piece 7. At its injection end, fuel injection valve 5 has a nozzle body 9 which has one or more spray openings for injection of the fuel into combustion chamber 3 of the internal combustion engine. On nozzle body 9, a conical section 10 which tapers in the direction toward the injection end 8 is formed.

To protect nozzle body 9 against overheating, a heat insulating sleeve 11 configured according to the invention and depicted in section view is provided in mounting hole 2. Thermal insulating sleeve 11 is composed of a sleeve body 12 extending essentially axially to longitudinal axis 4 and an upper collar 13 preferably extending radially outward to longitudinal axis 4 of sleeve body 12. Sleeve body 12 and collar 13 can be configured as an enveloping body which is completely closed in the circumferential direction. However, it is also possible to provide sleeve body 12 and collar 13 with an axial longitudinal slot to further improve the radial elasticity of thermal insulating sleeve 11 according to the invention.

Collar 13 rests on a first step 14 of mounting hole 2, which is configured as a stepped hole, of cylinder head 1, thus fixing the insertion depth of sleeve body 12 in a section 16 of mounting hole 2 configured as stepped hole between first step 14 and a second step 15 situated closer to combustion chamber 3. Section 16 can have a section 17 which tapers in the direction of combustion chamber 3 close to step 14, through which the introduction of thermal insulating sleeve 11 and nozzle body 9 of fuel injection valve 5 is facilitated.

At its injection end 18, sleeve body 12 has a preferably two-layered folded-back section 19. The folded-back section can be produced, by way of example, through bending or flanging. In addition, a conical section 20 which tapers in the direction of injection end 18 is provided which in the assembled state fits tightly against tapering conical section 10 of nozzle body 9 of fuel injection valve 5.

Figure 2:
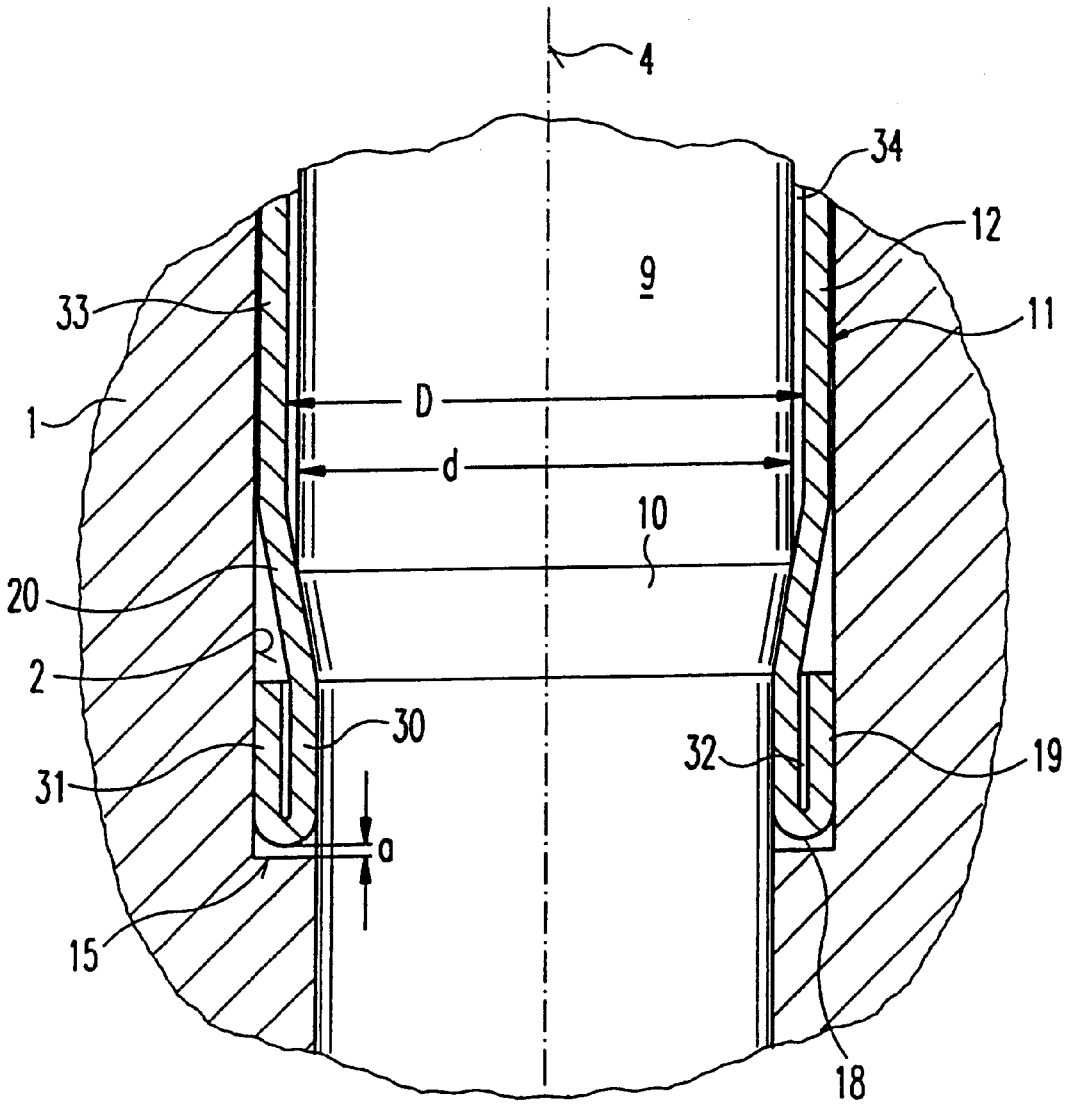
FIG. 2 shows an enlarged representation of section II in FIG. 1.

The configurations of folded-back section 19 and conical section 20 can be better seen in FIG. 2 which presents the area II in FIG. 1 in enlarged form. Elements which have already been described are provided with the same reference numbers making a repeated description to this extent unnecessary.

Folded-back section 19 in the depicted exemplary embodiment is bent to form a U shape at injection end 18 of sleeve body 12 so that sleeve body 12 has a two-layered configuration in the area of folded-back section 19. An inner layer 30 preferably fits tightly in an elastic manner on nozzle body 9 while an outer layer 31 of the preferably externally folded-back section 19 fits tightly in an elastic manner on mounting hole 2 of cylinder head 1. As a result of the tight fit of inner layer 30 on nozzle body 9 and of outer layer 31 on mounting hole 2, a good heat coupling of nozzle body 9 to cylinder head 1 is realized in this zone and overheating of the areas of fuel injection valve 5 further upstream in the direction away from combustion chamber 3 is counteracted. Advantageously, a gap 32 is formed between inner layer 30 and outer layer 31 of folded-back section 19 as a result of which the radial elasticity of folded-back section 19 is further improved.

Between injection end 18 of sleeve body 12 and second step 15 of mounting hole 2 of cylinder head 1 which is configured as a stepped hole, there advantageously is a gap designated with the letter "a" so that the final assembly position of thermal insulating sleeve 11 in mounting hole 2 is positively fixed by the striking of collar 13 on first step 14 of mounting hole 2. It is basically possible, however, for the final assembly position to be specified through striking of injection end 18 of sleeve body 12 against second step 15 of mounting hole 2. Collar 13 can then be omitted.

As already described, a conical section 20, tapered in the direction of injection end 18 of sleeve body 12, fits tightly against likewise tapered, conical section 10 of nozzle body 9 in the assembled state represented in FIG. 2. As a result, a friction-locked connection between nozzle body 9 and thermal insulating sleeve 11 according to the present invention is created so that thermal insulating sleeve 11 is carried axially with fuel injection valve 5 during the assembly until collar 13 strikes first step 14 of mounting hole 2. Conical section 20 is preferably arranged directly adjacent to folded-back, two-layer section 19 so that during the assembly, a slight elastic flaring of folded-back section 19 is effected as a result of which axial assembly force is reduced.

As a result of the tight fit of inner layer 30 of folded-back section 19 to nozzle body 9 and of outer layer 31 of folded-back section 19 to mounting hole 2 of cylinder head 1, an effective seal is achieved between nozzle body 9 and cylinder head 1 with respect to the combustion gases generated in combustion chamber 3. An additional component, in particular an additional sealing ring, is not necessary. Since folded-back section 19 preferably is formed of metal, this seal formed by folded-back section 19 is also extremely heat resistant in comparison with a seal ring composed of a rubber-elastic material.

Sleeve body 12 preferably has on the side of conical section 20 away from folded-back section 19 a hollow cylindrical section 33. To achieve a degree of thermal insulation in this area, hollow cylindrical section 33 does not fit tightly and flush on nozzle body 9 of fuel injection valve 5, but rather is separated from nozzle body 9 by a ring-shaped gap 34. Gap 34 is formed because hollow cylindrical section 33 has an internal diameter D which is larger than external diameter d of the area of nozzle body 9 which is enclosed by hollow cylindrical section 33. Hollow cylindrical section 33 can fit flush against mounting hole 2 of cylinder head 1. Through the interaction of tapered conical section 10 of nozzle body 9 and tapered conical section 20 of sleeve body 12, a self-centering of nozzle body 9 within hollow cylindrical section 33 of sleeve body 12 is realized so that nozzle body 9 is separated essentially uniformly from hollow cylindrical section 33.

Sleeve body 12 together with collar 13 can be formed as a one-piece sheet metal part. Thermal insulating sleeve 11 according to the present invention can therefore be manufactured in a cost-effective fully or partially automatic manufacturing process through deep drawing or through rolling. Elaborate preassembly of thermal insulating sleeve 11 on fuel injection valve 5 is not required. During assembly, either thermal insulating sleeve 11 is pushed at least partially onto nozzle body 9 of fuel injection valve 5 and the unit composed of fuel injection valve 5 and thermal insulating sleeve 11 is introduced into mounting hole 2 or thermal insulating sleeve 11 is placed in mounting hole 2 before nozzle body 9 is introduced into mounting hole 2. The elasticity of thermal insulating sleeve 11 achieved as a result of folded-back section 19 limits the required assembly force which must be applied in axial direction.

As described, thermal insulating sleeve 11 according to the present invention combines the functions of ease of assembly, an effective seal against the combustion gases, and effective dissipation of heat.

What is claimed is:

1. A thermal insulating sleeve for a fuel injection valve, the fuel injection valve being inserted into a mounting hole of a cylinder head of an internal combustion engine, the fuel injection valve providing a direct injection of a fuel into a combustion chamber of the internal combustion engine, the thermal insulating sleeve comprising:

a sleeve body at least partially enveloping a nozzle body of the fuel injection valve, the sleeve body having a conical section and a folded-back section at an injection end of the sleeve body, the sleeve body having two layers in the folded-back section, the conical section tapering in a direction toward the injection end, the conical section, in an assembled state, tightly fitting against a tapered section of the nozzle body;

wherein, in the assembled state, an inner layer of the two layers tightly fits against the nozzle and an outer layer of the two layers tightly fits against the mounting hole; and wherein a gap is formed between the inner layer and the outer layer.

2. The thermal insulating sleeve according to claim 1, wherein the sleeve body is bent, at the injection end, in a U-shape to form the folded-back section.

3. The thermal insulating sleeve according to claim 1, wherein the folded-back section follows directly in a downstream direction of the conical section.

4. The thermal insulating sleeve according to claim 1, wherein the sleeve body has a hollow cylindrical section, the hollow cylindrical section joining the conical section on a side, the side being positioned away from the folded-back section.

5. The thermal insulating sleeve according to claim 4, wherein an internal diameter of the hollow cylindrical section is larger than an external diameter of a section of the nozzle body, the nozzle body, in the assembled state, being inserted into the hollow cylindrical section.

6. The thermal insulating sleeve according to claim 1, further comprising:

a collar joining the sleeve body at a further end, the further end being positioned away from the injection end.

7. The thermal insulating sleeve according to claim 6, wherein the collar extends perpendicular to a longitudinal axis of the sleeve body.

8. The thermal insulating sleeve according to claim 6, wherein the sleeve body and the collar are configured as a one-piece deep-drawn sheet metal part.

9. The thermal insulating sleeve according to claim 1, wherein the folded-back section is manufactured using one of a flanging process and a bending process.

10. A thermal insulating sleeve for a fuel injection valve, the fuel injection valve being inserted into a mounting hole of a cylinder head of an internal combustion engine, the fuel injection valve providing a direct injection of a fuel into a combustion chamber of the internal combustion engine, the thermal insulating sleeve comprising:

a sleeve body at least partially enveloping a nozzle body of the fuel injection valve, the sleeve body having a conical section and a folded-back section at an injection end of the sleeve body, the sleeve body having two layers in the folded-back section, the conical section tapering in a direction toward the injection end, the conical section, in an assembled state, tightly fitting against a tapered section of the nozzle body;

wherein, in the assembled state, an inner layer of the two layers tightly fits against the nozzle and an outer layer of the two layers tightly fits against the mounting hole.

* * * * *